United States Patent [19]

Barley et al.

[11] 4,327,994

[45] May 4, 1982

[54] PROGRESSIVE DISCLOSURE COPYING MACHINE CONSOLE USING COMMON KEYS FOR COPY NUMBER AND FUNCTION SELECT OPERATIONS

[75] Inventors: Steven D. Barley, Rochester; Stephen K. Bright, Fairport, both of N.Y.

[73] Assignee: Xerox Corporation, Stamford, Conn.

[21] Appl. No.: 153,642

[22] Filed: May 27, 1980

[51] Int. Cl.[3] ..... G03G 15/00

[52] U.S. Cl. ..... 355/14 R; 340/711

[58] Field of Search ..... 355/14 R, 14 C, 14 CU; 340/711; 364/518

[56] References Cited

U.S. PATENT DOCUMENTS 3,940,210 2/1976 Donohue ..... 355/14 C 4,054,380 10/1977 Donohue et al. ..... 355/14 R 4,260,241 4/1981 Honma et al. ..... 355/14 R

*Primary Examiner*—Richard L. Moses

[57] ABSTRACT

Disclosed is a copying machine operator console having a keyboard (17), a copying number display (23), a message display (13,15) and a control means (19) operating the copy number and message displays. The control means causes the message display to prompt an operator to enter a number of desired copies using predetermined keys of the keyboard and also causes the message display to sequentially display selected messages instructing an operator to enter with said predetermined keys machine function selection information. The control means also causes the copy number display to display the operator selected number of copies.

8 Claims, 8 Drawing Figures

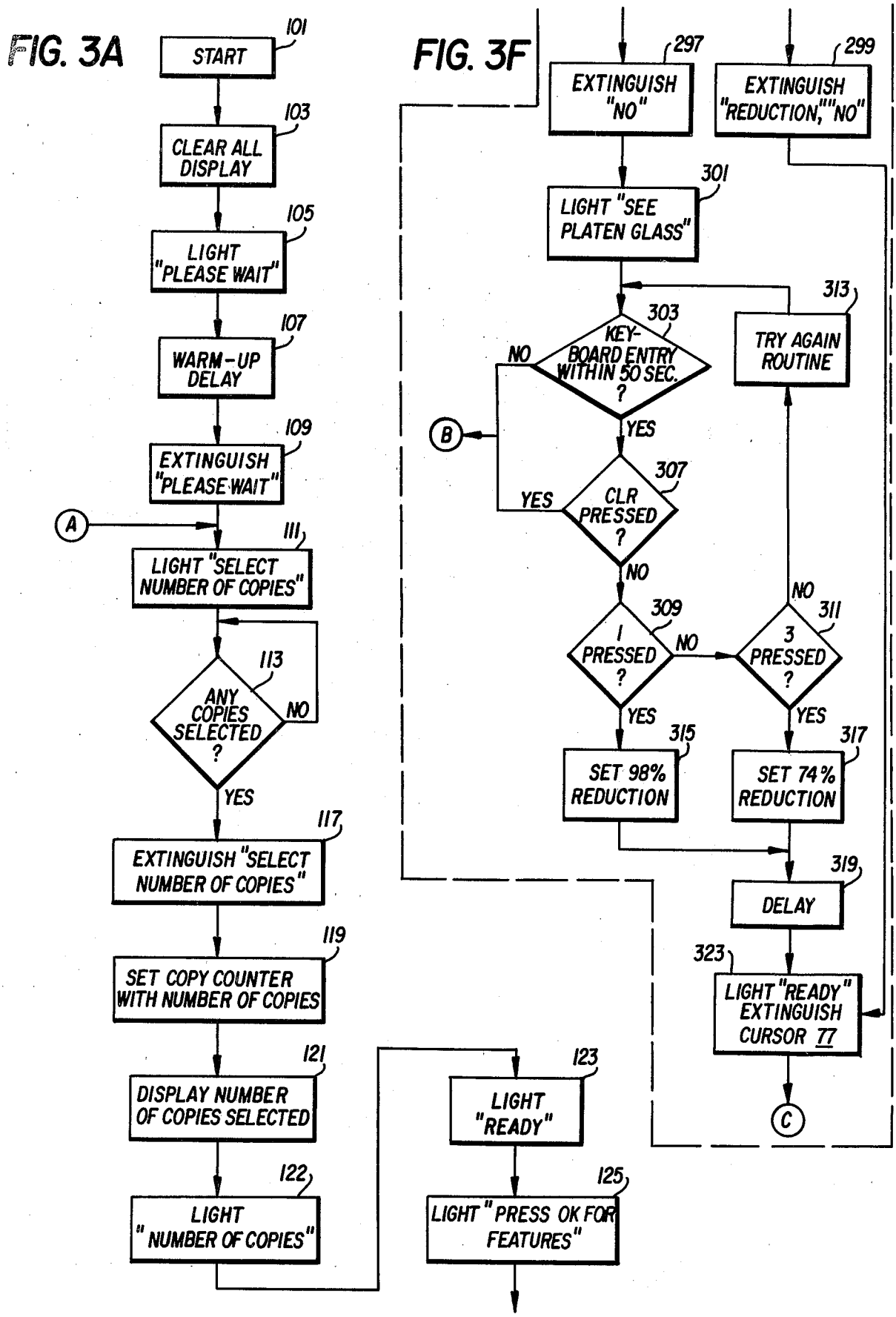
FIG. 3A
START
101
CLEAR ALL DISPLAY
103
LIGHT "PLEASE WAIT"
105
WARM-UP DELAY
107
EXTINGUISH "PLEASE WAIT"
109
A
LIGHT "SELECT NUMBER OF COPIES"
111
ANY COPIES SELECTED ?
113
NO
YES
EXTINGUISH "SELECT NUMBER OF COPIES"
117
SET COPY COUNTER WITH NUMBER OF COPIES
119
DISPLAY NUMBER OF COPIES SELECTED
121
LIGHT " NUMBER OF COPIES"
122
LIGHT "READY"
123
LIGHT "PRESS OK FOR FEATURES"
125
FIG. 3F
EXTINGUISH "NO"
297
EXTINGUISH "REDUCTION,""NO"
299
LIGHT "SEE PLATEN GLASS"
301
KEY-BOARD ENTRY WITHIN 50 SEC. ?
303
NO
YES
B
TRY AGAIN ROUTINE
313
CLR PRESSED ?
307
YES
NO
1 PRESSED ?
309
NO
3 PRESSED ?
311
NO
YES
YES
SET 98% REDUCTION
315
SET 74% REDUCTION
317
DELAY
319
LIGHT "READY" EXTINGUISH CURSOR 77
323
C

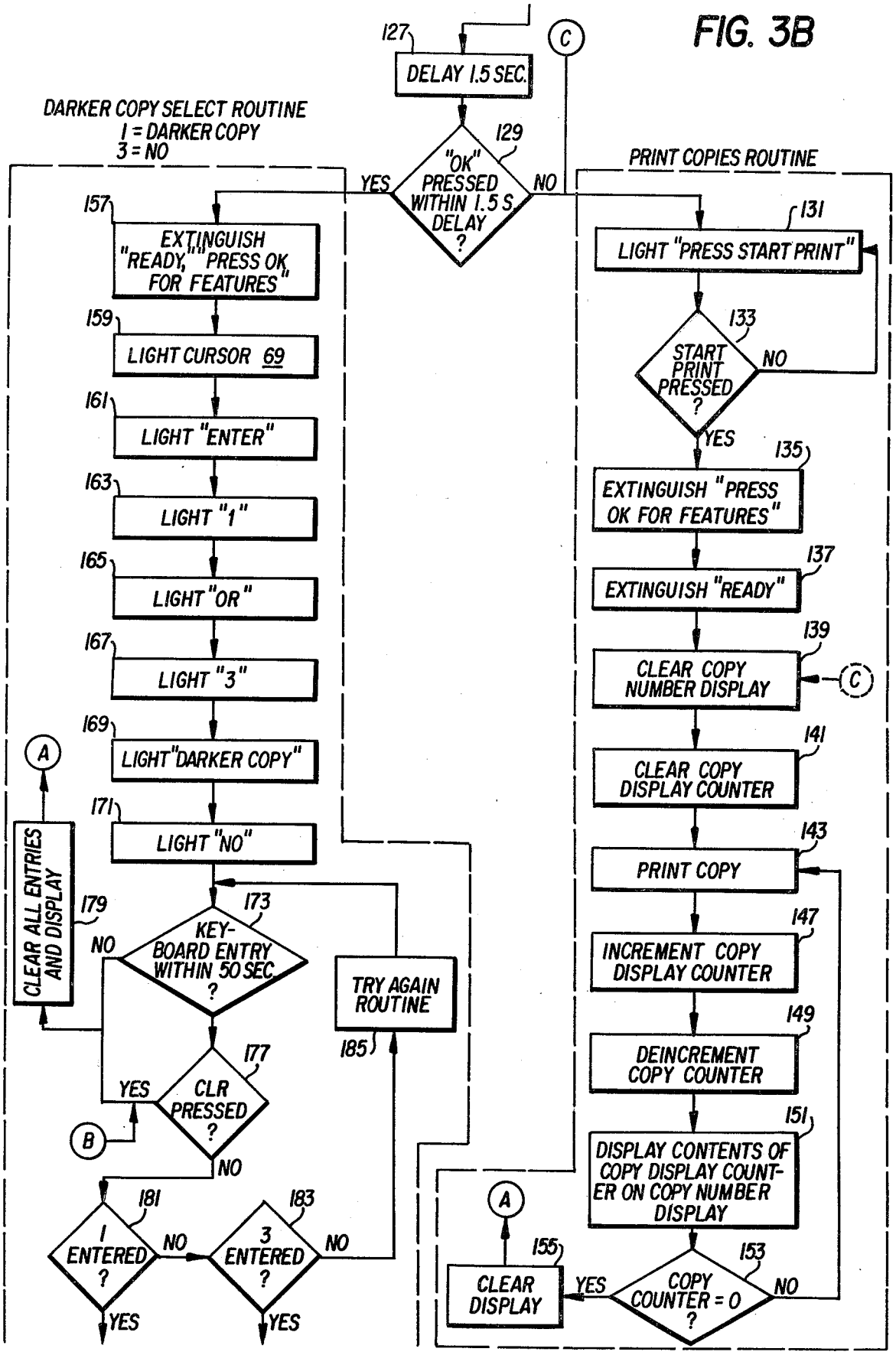
FIG. 3B
127
DELAY 1.5 SEC.
C
129
"OK" PRESSED WITHIN 1.5 S. DELAY ?
YES
NO
DARKER COPY SELECT ROUTINE
1 = DARKER COPY
3 = NO
157
EXTINGUISH "READY," "PRESS OK FOR FEATURES"
159
LIGHT CURSOR 69
161
LIGHT "ENTER"
163
LIGHT "1"
165
LIGHT "OR"
167
LIGHT "3"
169
LIGHT "DARKER COPY"
171
LIGHT "NO"
173
KEY-BOARD ENTRY WITHIN 50 SEC. ?
NO
179
CLEAR ALL ENTRIES AND DISPLAY
A
TRY AGAIN ROUTINE
185
177
CLR PRESSED ?
YES
B
NO
181
1 ENTERED ?
NO
YES
183
3 ENTERED ?
NO
YES
PRINT COPIES ROUTINE
131
LIGHT "PRESS START PRINT"
133
START PRINT PRESSED ?
NO
YES
135
EXTINGUISH "PRESS OK FOR FEATURES"
137
EXTINGUISH "READY"
139
CLEAR COPY NUMBER DISPLAY
C
141
CLEAR COPY DISPLAY COUNTER
143
PRINT COPY
147
INCREMENT COPY DISPLAY COUNTER
149
DEINCREMENT COPY COUNTER
151
DISPLAY CONTENTS OF COPY DISPLAY COUNTER ON COPY NUMBER DISPLAY
153
COPY COUNTER = 0 ?
YES
NO
155
CLEAR DISPLAY
A

PROGRESSIVE DISCLOSURE COPYING MACHINE CONSOLE USING COMMON KEYS FOR COPY NUMBER AND FUNCTION SELECT OPERATIONS

As society advances and more complex and varied office machines are developed increasing problems occur in instructing operators in their proper operation. Nowhere in this problem more evident than in the area of office copying machines as the continued evolution of these machines has resulted in highly sophisticated and complex function-rich machines. Typical selected functions include darker or lighter copies, alternate paper size, stacked or stapled copy orientation, copying on one or both sides of a paper sheet from one or both sides of an original, reduction and sorting; other functions may also be available. Substantial efforts have been devoted in the design and layout of such machines to enhance an operators understanding and reduce the possibility of operator entry errors. However, the more complex function-rich copying machines have operator interactive consoles consisting of an array of buttons, knobs, and indicator lights associated with copy number and machine function selections which presents a confusing array of information to an operator, particularly an untrained or casual operator. This increases operator entry errors and consequent undesired machine operation, and causes a general waste of time and copy machine materials.

Additionally, the more function rich the copying machine, the more mechanical and electrical components which are required for display and operator entries, which increases the overall cost of the operator console, while reducing its reliability.

Examples of complex, function-rich copying machines and their sophisticated operator consoles can be found in U.S. Pat. Nos. 4,035,072 and 4,158,886.

Efforts have been made to improve the presentation of information to an operator by limiting the number of instructions or information messages displayed at any one time and by guiding an operator through a step-by-step sequence of displayed messages prompting operator entries. Systems employing this idea are disclosed in U.S. patent applications Ser. No. 89,429 and Ser. No. 89,433, both filed Oct. 30, 1979. Another system which successively prompts operator inputs to a copying machine is disclosed in IBM Technical Disclosure Bulletin, Volume 18, No. 10, 1976. Yet another system which uses sequential message presentation and which also simplifies the copying machine operating console by using a CRT display and operator entry overlay is disclosed in U.S. application Ser. No. 99,352, filed Dec. 3, 1979.

While sequential message systems prompting operator console entries do improve operator interaction with a copying machine, a significant number of expensive entry and display components are still required.

Accordingly, one feature of the present invention is a reduction in potential operator confusion and erroneous copy and function select input operations caused by conventional copying machine operator interactive display consoles. In accordance with the invention, an operating console is provided which sequentially presents operator input instructions prompting an operator to enter both copy number and function selection information using the same keys of a single keyboard. As a result, the vast array of buttons typically associated with the operating console of a function rich copying machine can be eliminated in favor of a simplified keyboard input device.

An additional feature of the invention is a further reduction in operator confusion achieved by concentrating the operator's attention to message instructions which are displayed in a readily understandable manner at a centralized display area.

An additional feature of the invention is the provision of an operator interactive display console for a copying machine which, by utilizing common keys for both copy select and function select operations, reduces manufacturing and maintenance costs while improving operator performance.

An additional feature of the invention is the provision of an operator interactive display console as above having a control circuit formed of relatively few electronic components, thus considerably reducing the number of logic elements required as well as lowering costs.

An additional feature of the invention is the provision of a progressive disclosure console using common keys for copy number and function selections, which has a programmable control circuit which can be readily reprogrammed for different machines having different available functions.

A yet additional feature is the provision of a progressive operator display console for a copying machine comprising a keyboard having predetermined keys for selecting a number of copies to be reproduced by said machine; a copy number display for displaying a selected number of copies; a message display comprising a plurality of individual operator prompting messages selectively displayed to an operator to instruct an operator in the selection of available copying machine functions; and, a control means coupled to the keyboard, the copy number display, and the message display for operating the message display to display a message prompting an operator to enter a number of desired copies with the predetermined keys of the keyboard and for sequentially displaying selected messages instructing an operator to enter, with the predetermined keys, machine function selection information, the control means being responsive to the number of desired copies and function selection information entered by an operator with the keys to cause the copy number display to display the desired number of copies and for conditioning the copying machine to operate according to the entered function selection information.

These and other features and advantages of the invention will be readily understood from the ensuing description of an exemplary embodiment which is provided in conjunction with the accompanying drawings.

Figure 1:
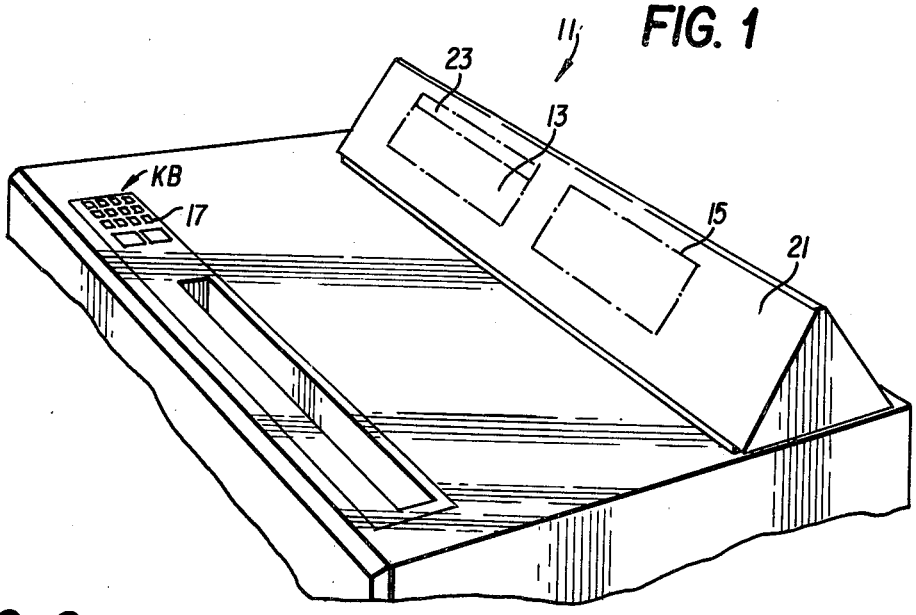
FIG. 1 shows a portion of a copying machine including an operator interactive display console.
Figure 2:
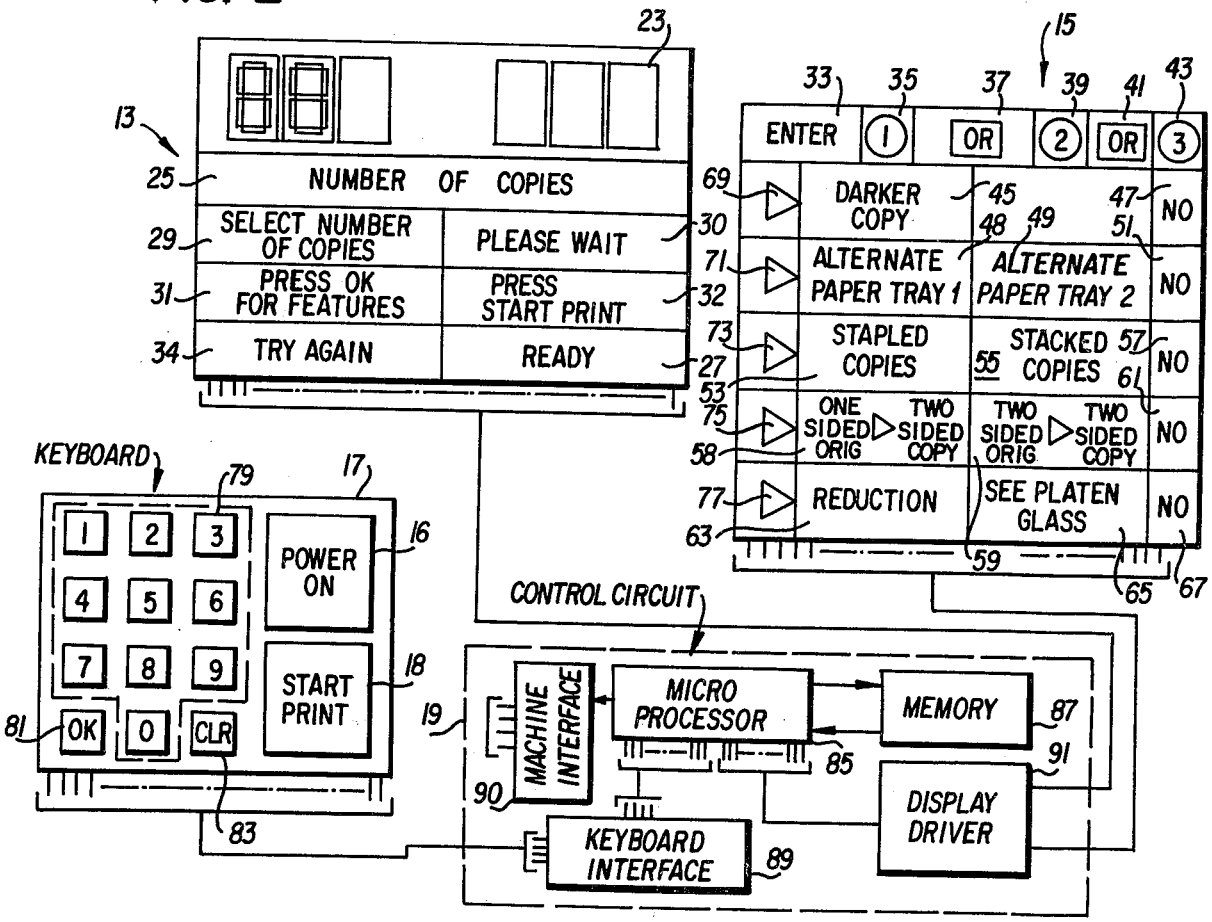
FIG. 2 illustrates in block diagram form the control system for the operator interactive display console illustrated in FIG. 1; and, FIGS. 3A, 3B, 3C, 3D, 3E and 3F collectively illustrate a flow chart implementation of an exemplary program executed by the microprocessor illustrated in FIG. 2.
Figure 3C:
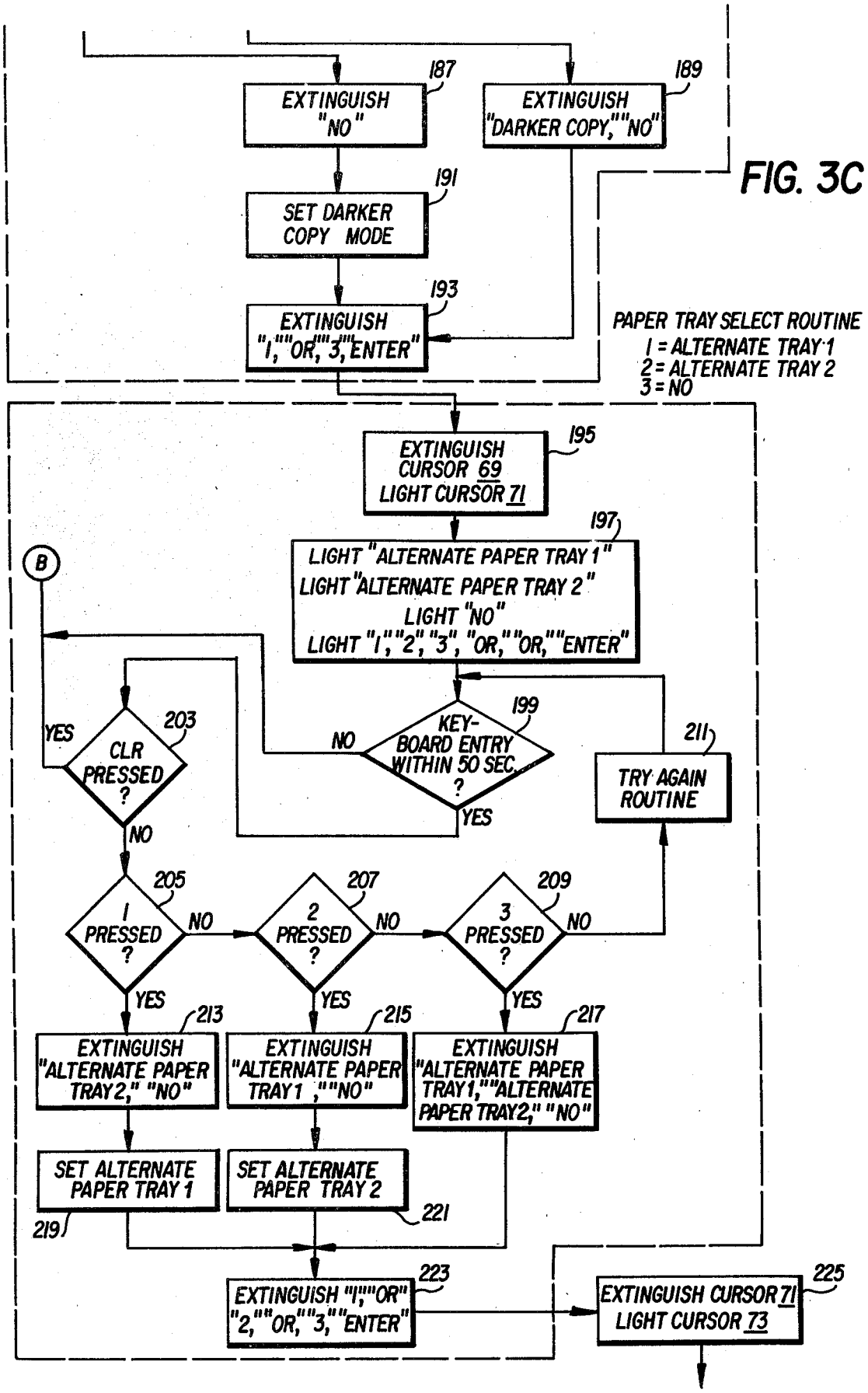
Figure 3D:
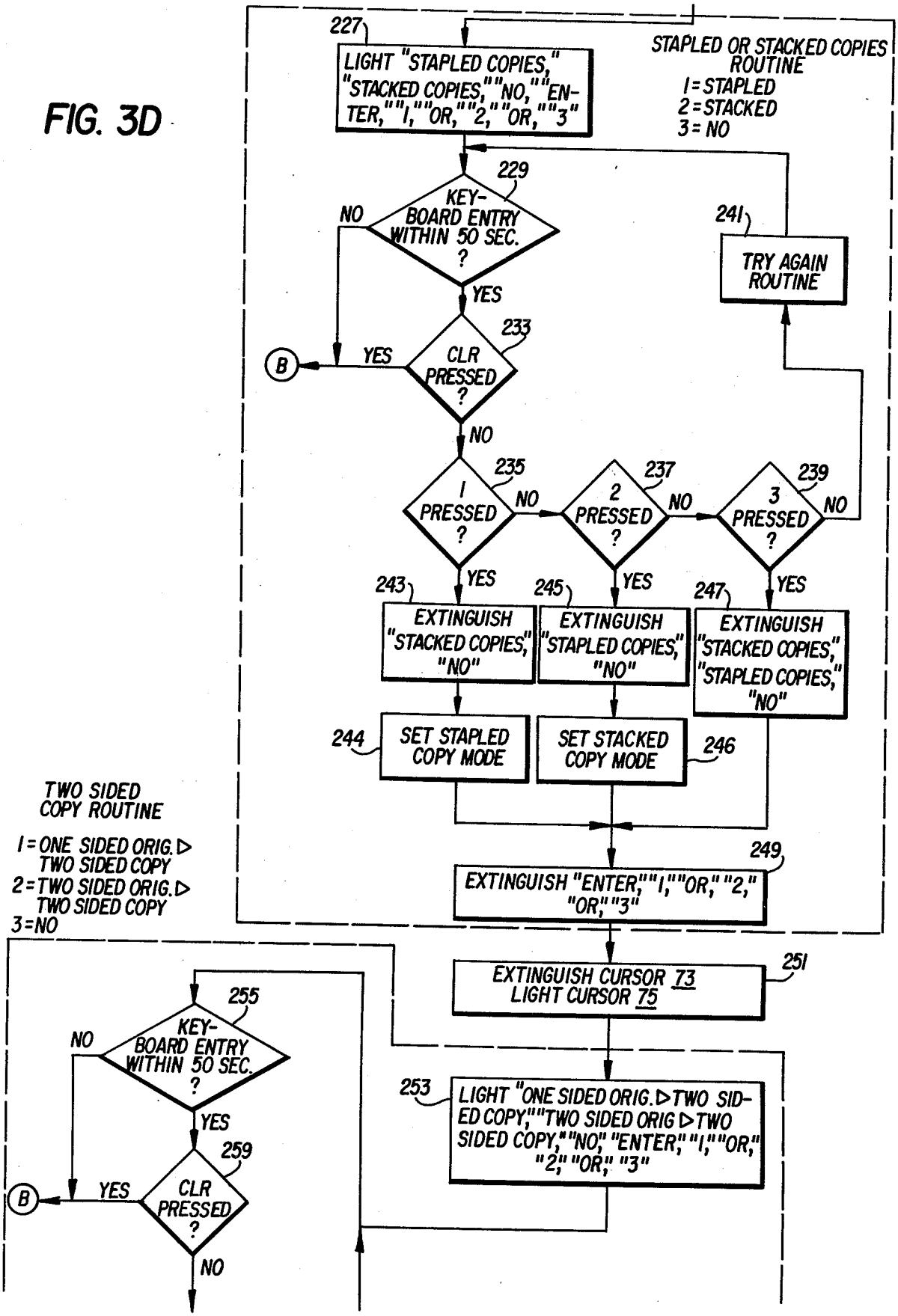
Figure 3E:
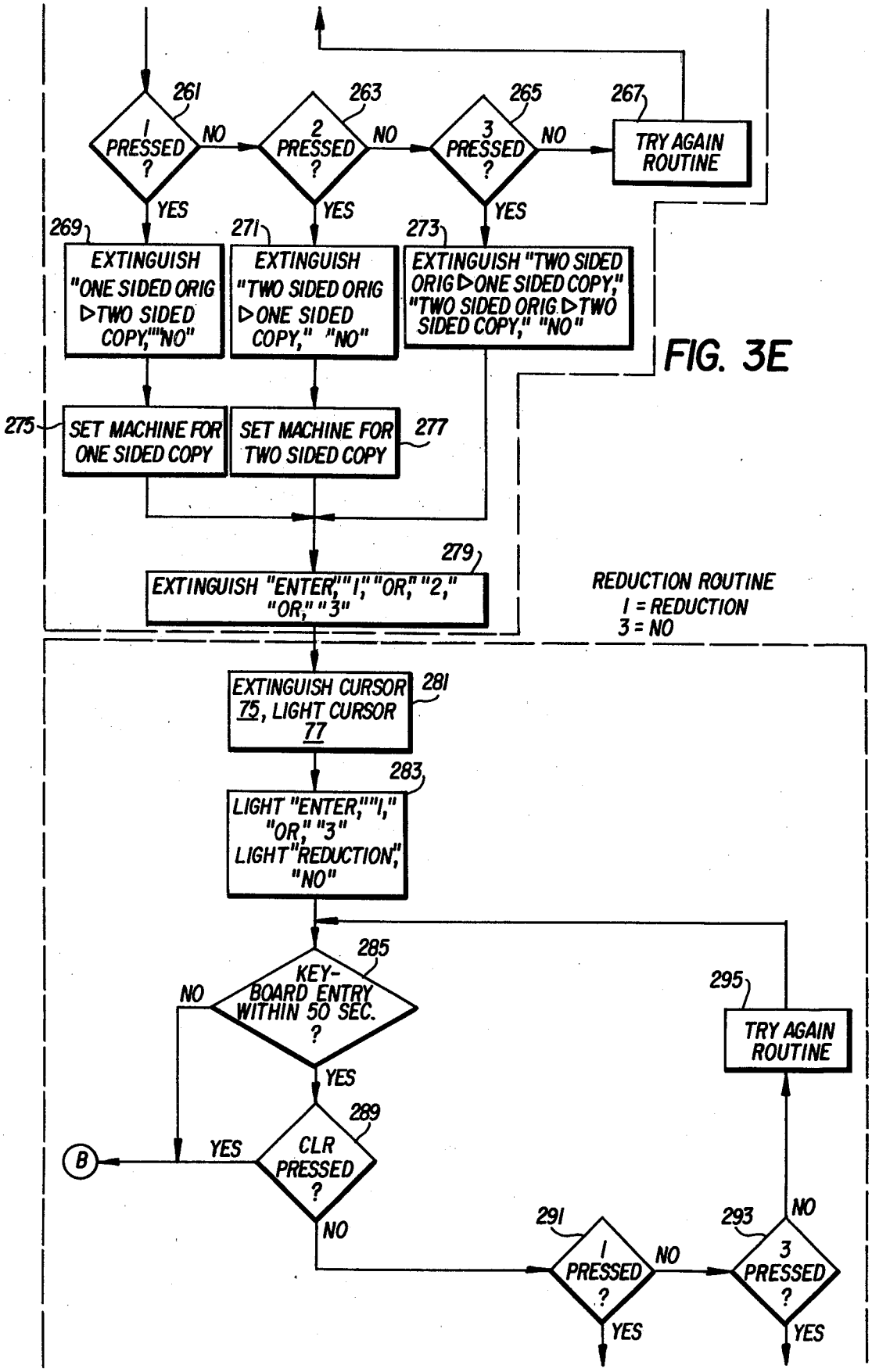

FIG. 1 illustrates a portion of a copying machine 11 embodying the invention which includes an operator interactive console including a keyboard 17 and message display areas formed as display groups 13 and 15. The display areas are provided by a display overlay 21 having back lighted messages areas. As known in the art, these messages are rendered readable to an operator by lighting a lamp behind a selected message.

The mechanical details of operation of the copying machine 11 illustrated in FIG. 1 do not form a part of this invention and accordingly are not shown for the purposes of simplicity. A detailed description of the mechanics of an exemplary copying machine with which the invention may be used is found in the above referred to U.S. Pat. Nos. 4,158,886 and 4,035,072. The term copying machine as used herein is generic to any type of image reproducing machine whether the final copy is produced by impact printing, electrostatographic techniques, laser printing, ink jet printing or any other method of affixing a reproduced image on an object.

An alphanumeric information display area 23 containing seven segment liquid crystal or light emitting diode display elements is provided adjacent display group 13, the latter including an area 25 containing the display message NUMBER OF COPIES, an area 27 containing the message READY, an area 29 containing the message SELECT NUMBER OF COPIES, an area 31 containing the message PRESS OK FOR FEATURES, an area 30 containing the message PLEASE WAIT, an area 32 containing the message PRESS START PRINT, and an area 34 containing the message TRY AGAIN. The message areas of display group 13 can be positioned in any desired arrangement and it is not required that each of these messages be formally grouped as a display group, it being sufficient that they appear somewhere on the display portion of the operator console and that the message NUMBER OF COPIES be adjacent the alphanumeric display area 23. The messages in display group 13 are lit at appropriate times during operator interaction with a copying machine by an operator console control circuit 19 as described in detail below.

The second display group 15 comprises a plurality of individual messages which are so arranged that selected individual messages can be simultaneously energized, by actuating their associated lights, to produce specific operator function selection instruction messages. The individualized messages are grouped in rows and columns of display group 15. Each row of display group 15 after the first includes individual messages pertaining to a particular machine function which can be selected, for example, darker copies, paper size, stapled or stacked copies, one or two sided copying, and copy reduction. The top row of display group 15 includes individual operator messages pertaining to how the desired functions can be selected using certain keys of the copy number selection keyboard 79.

The top row of display group 15 includes an area 33 containing the message ENTER, an area 35 containing the message "1," an area 37 containing the message OR, an area 39 containing the message "2," and area 41 containing the message OR, and an area 43 containing the message "3." Areas 35, 39 and 43, corresponding to messages "1," "2," and "3" are arranged to reside over three separate columns of function selection messages in display group 15.

Each row below the first row of message display group 15 begins with a cursor message (69, 71, 73, 75 and 77). The cursor messages are sequentially energized or lit as described in further detail below to progressively and successively direct an operator's attention to each of the second through sixth rows of display group 15. Each of the second through sixth rows of display group 15 also contains additional individual message units which are selectively energized or lit as described below to provide, together with a message display in row 1, an operator message prompting a keyboard 79 entry for a selected function. The second row of display group 15 includes the individual message DARKER COPY in the column below area 35, and the message NO in the column below area 43. The third row includes an area 48 containing the message ALTERNATE PAPER TRAY 1, an area 49 containing the message ALTERNATE PAPER TRAY 2, and an area 51 containing the message NO. These areas are respectively provided in columns under areas 35, 39, and 43. The fourth row of display group 15 includes an area 53 containing the message STAPLED COPIES, an area 55 containing the message STACKED COPIES and an area 57 containing the message NO. These latter three areas are respectively arranged in the columns under areas 35, 39 and 43. The fifth row of display group 15 includes an area 58 containing the message ONE SIDED ORIGINAL ▷ TWO SIDED COPY, an area 51 containing the message TWO SIDED ORIGINAL ▷ TWO SIDED COPY, and an area 61 containing the message NO. The last three messages are again respectively provided in columns below areas 35, 39, and 43 of the first row of display group 15. The last row of display group 15 has an area 63 containing the message REDUCTION, an area 65 containing the message SEE PLATEN GLASS, and an area 67 containing the message NO. Again, these latter three messages are provided in columns under respective display areas 35, 39 and 43 of row 1 of display group 15.

For any given function selection message row, after the first, all function selection messages are simultaneously lit with the corresponding row cursor. The function select prompting messages and row cursors appearing in the various rows of display group 15 following the first are also displayed in a progressive sequence. As messages in each function selection row are displayed, keyboard entry messages are simultaneously displayed in row 1 instructing an operator to press keyboard buttons "1," "2," or "3" to select one of the lit functions displayed in the column under the lighted messages for these keys. After a function selection keyboard entry is detected, the message in the first or second columns corresponding to the function selected remains lit while the remaining row messages are extinguished. If a "3" keyboard entry is detected, corresponding to an operator's selecting none of the available functions for a particular row, all message lights in a row are extinguished.

A description of the manner in which display group 15 sequentially provides operator prompting messages instructing function selecting keyboard inputs under control of a console control system now follows. The first function requiring an operator selection is for selecting a darker copy. For this, cursor 69 is lit together with the message DARKER COPY, and NO in row two of display group 15. Simultaneously therewith, the individual messages ENTER, "1," OR (area 37), and "3" in row 1 are lit. Areas 39 and 41 of row 1 remain blanked. By arranging the lit "1" message over the DARKER COPY message and the lit "3" message over the NO message, an operator is instructed to press 1 or 3 depending on whether a darker copy is desired, or not. Upon an operator's keyboard entry, cursor 69 is extinguished. In addition, if a "1" was entered, the NO light is extinguished, while the DARKER COPY light remains lit to remind the operator this function was selected. If a "3" was entered, all messages in row two are extinguished, including cursor 69.

For selection of the next function, cursor 71 is next lit together with areas 48, 49 and 51 displaying the three messages ALTERNATE PAPER TRAY 1, ALTERNATE PAPER TRAY 2 and NO. These messages are respectively aligned under the "1," "2," and "3," display messages in row 1 which are also all lit. In addition, the area 33 displaying the ENTER message, area 37 displaying an OR message between the lit "1" and "2," and area 41 displaying the OR message between lit areas "2" and "3" are also lit. The operator is thus instructed to press "1," "2," or "3" to select an alternate paper tray 1, an alternate paper tray 2, or neither. Upon selection of the desired paper tray, by the operator pressing a "1," or "2" on the keyboard, an associated display area 48 or 49 corresponding to the selected operation remains lit, while the others are extinguished together with cursor 71. If a "3" was pressed, all display messages in row 3, including cursor 71, are extinguished.

The process then repeats in sequence for each of the remaining rows 4 through 6 of display group 15 as the cursor and message units for each row are displayed together with appropriate keyboard selection information in row 1 prompting an operator to sequentially enter data pertaining to selection of the remaining function(s) available on a particular copying machine. For purposes of description, it is assumed, as illustrated in FIG. 1, that the copying machine with which the invention is used has the options of stapled or stacked copies, one sided original to two sided copying or two original to two sided copying, and reduction, in addition to the copy contrast and tray selections described above.

Both display group 13 and display group 15 are controlled by control circuit 19 which includes a microprocessor 85 executing a program described in detail below. Microprocessor 85 communicates with a memory 87 including a ROM (read only memory) for program storage and a RAM (random access memory) for dynamic operating storage, a display driver 91, a keyboard interface 89 and a machine control interface 90. The display driver 91 converts, in a well known manner, binary information from the microprocessor 85 output ports representing messages to be displayed to on-off light energizing control signals for the message lights of display group 13 and display group 15. For display group 15, the display driver 91 lights appropriate ones of the function selection instructing messages to provide the progressive prompting message sequence described above.

Microprocessor 85 executes a program stored in the ROM of memory 87 to first light message SELECT NUMBER OF COPIES in display group 13 prompting an operator to enter, via keys 79, the number of copies desired and to thereafter successively prompt an operator to enter function selection data via keys 79 by means of the function selection messages displayed in display group 15. The microprocessor 85 receives inputted keyboard information through a conventional keyboard interface 89 and supplies control signals to a copying machine corresponding to selected functions through a conventional machine interface 90. The microprocessor 85 and associated memory 87 may be formed of conventionally available IC (integrated circuit) components. One suitable microprocessor is known in the art as the 8080 which is available from Intel Corporation.

Keyboard interface 89 connects microprocessor 85 with a keyboard 17 which includes a copy select keys 79 and additional keys 81 and 83 having respective legends OK and CLR, the latter representing a CLEAR input. Keyboard 17 also includes the usual keys for POWER ON, and START PRINT, conventionally associated with a copying machine.

The program executed by microprocessor 85 which sequentially prompts operator entries at keyboard 17 is shown in FIGS. 3A–3F, which are connected in alphabetical sequence. The program is initiated at step 101 in response to operator actuation of the POWER ON key 16. Subsequent step 103 causes the microprocessor to clear all display messages in both display group 13 and display group 15 and in step 105 microprocessor 85 energizes the PLEASE WAIT message, i.e. area 30 of display group 13, by sending a code signal corresponding to the PLEASE WAIT message to display driver 91 which in turn lights the light residing behind the PLEASE WAIT message area 30 on display panel 21. The microprocessor then establishes a time delay in step 107 to enable the copying machine to assume a ready state. This enables, for example, the fuser stage to attain its predetermined operating temperature. Following the delay in step 107, microprocessor 85 advances to step 109 where it extinguishes the PLEASE WAIT message (area 30) and from there proceeds to step 111 where it lights the message SELECT NUMBER OF COPIES. (To simplify the following discussion, description of the control of a message light by the display driver 91 will be omitted, it being understood that all control of message lights by the microprocessor occurs through this device.)

After lighting the message SELECT NUMBER OF COPIES microprocessor 85 determines in step 113 whether any copies have been selected. If not, microprocessor 85 recycles through step 113 awaiting a keyboard input. Once a copy number select input has been detected in step 113, the microprocessor 85 extinguishes the SELECT NUMBER OF COPIES light and sets an internal copy counter with the number of copies inputted via keys 79 of keyboard 17, as detected in step 113. The number of copies selected is displayed in step 121 on alphanumeric display 23, the NUMBER OF COPIES message (area 15) is lit in step 122 and thereafter the READY light is lit in step 123. Following this, the microprocessor lights the message PRESS OK FOR FEATURES (area 31) in step 125 and then executes a 1.5 second delay period in step 127. In following step 129, a determination is made if the OK key was pressed within the 1.5 second delay period. If not, the program branches to a print copies routine and, if so, the program branches to begin a functions selection routine. Thus, if no keyboard entry is detected in the 1.5 second delay, the microprocessor automatically cycles the copying machine into a print routine. On the other hand, if an OK keyboard entry is detected during the delay period, the microprocessor continues on to the progressive disclosure of function selection message instructions.

If the OK key was not pressed during the 1.5 second delay, the print routine is initiated in step 131 wherein the microprocessor lights the PRESS START PRINT message (area 32) in display group 13, and proceeds to step 133 where it determines whether the START PRINT key 18 was depressed. If key 16 was not pressed, the program cycles through step 131 until a depression of the START PRINT key is detected at which time microprocessor 85 continues to step 135 where it extinguishes the PRESS OK FOR FEATURES message light.

In step 137 the program microprocessor extinguishes the READY light and in step 139 it clears the copy number display 23. Following this, a copy display counter formed by the microprocessor is cleared in step 141 and a print instruction is executed in step 143 instructing the copying machine to execute a printing operation. Following execution of the print copy step 143, the microprocessor advances to step 147 where it increments the copy display counter and then to step 149 where it deincrements the copy counter. Following this, in step 151, the microprocessor displays the contents of the copy display counter on the copy number display 23. In step 153 the microprocessor determines whether the copy counter equals zero. If it does, all of the display lamps in display group 13 and display group 15 are cleared and the microprocessor cycles back to step 111 where it awaits a new series of operator inputs. If the copy counter does not equal zero in step 153, the microprocessor cycles back to the print copy step 143 and begins printing the next copy of an original document. When the microprocessor finally determines in step 153 that the copy counter equals zero, the printing cycle is completed, the display cleared in step 155, and the microprocessor cycles back to step 111.

Returning to step 129, if the OK key was pressed within the 1.5 second delay established in step 127, the microprocessor next extinguishes the READY and PRESS OK FOR FEATURES lights in step 157. Thereafter, in step 159 the microprocessor lights cursor 69 of display group 15 and further lights ENTER in step 161, "1" in step 163, the first OR (area 35) in step 165, "3" in step 167, DARKER COPY in step 169 and NO (area 47) in step 171. The microprocessor operations in steps 157 through 171 lights individual messages in display group 15 to instruct an operator to enter a "1" or "3" on the keyboard, which respectively align over the DARKER COPY and NO messages, depending on whether a darker copy is desired or not.

Following step 171, the microprocessor proceeds to step 173 where it determines if a keyboard entry is received within a 50 second interval. This delay is provided to insure that the microprocessor recycles itself back to a beginning position (step 111) if an operator walks away from a machine in the middle of a function selection operation. This prevents the system from being "hung up" awaiting an input. If a keyboard entry is not received within a 50 second duration, the microprocessor proceeds to step 179 where it clears all previously recorded keyboard entries and all display lights in display group 13 and 15 and display 23 and then returns to step 111.

Assuming a keyboard entry is received within the 50 second interval established in the step 173, the microprocessor proceeds to step 177 and determines whether the keyboard entry was a CLEAR instruction (CLR being depressed). If it was, microprocessor branches to step 179 where it again clears all recorded keyboard entries as well as the display and returns the program to step 111 awaiting a new copy select operation. If the CLR key was not pressed, the microprocessor proceeds to steps 181 and 183 where it determines which of the keyboard inputs "1" and "3" was entered.

If a "1" was entered the microprocessor proceeds from step 181 to step 187, whereas if a "3" was entered, the microprocessor advances to step 183 and from there to step 189. If a key other than "1" or "3" was pressed, microprocessor branches from step 183 to a "try again rountine" in step 185 which may include lighting additional prompting messages instructing the operator to re-enter his input. Such a rountine may include temporarily displaying the message "TRY AGAIN" (area 34) which may be provided as part of display group 13. After passing through step 185, the microprocessor returns to step 173 where it determines if a keyboard entry occurs within a 50 second interval.

If an operator pressed a "1" requesting a darker copy, step 181 directs the microprocessor to continue to step 187 where the NO message (area 47) is extinguished leaving the DARKER COPY message 45 lit. The microprocessor then proceeds to step 191 where it sets a darker copy mode for the reproduction machine via machine interface 90.

If the operator pressed the "3" key indicating a darker copy is not desired, the microprocessor proceeds from step 183 to step 189 where both the NO (area 47) and DARKER COPY message areas are extinguished.

Proceeding from either step 191 or 189, the microprocessor continues to step 193 where it extinguishes the ENTER, "1," OR (area 37) and "3" message areas in row 1 of display group 15. The microprocessor then extinguishes the message light for cursor 69 in step 195 while lighting the cursor message light 71. Following this, in step 197 the microprocessor lights all of the message areas in row 3 of display group 15; that is, ALTERNATE PAPER TRAY 1, ALTERNATE PAPER TRAY 2, and NO (area 51). In addition, all display message lights in row 1 of display group 15 are also energized, i.e., "1," "2," "3," OR (area 37), OR (area 41) and ENTER.

At this point the microprocessor has now displayed to an operator a message which reads "ENTER 1 OR 2 OR 3," to respectively select a first alternate paper tray, a second alternate paper tray, or neither, the latter indicating that the normally used paper tray is desired.

Following step 197 the microprocessor proceeds to step 199 where it determines whether a keyboard entry is received within a 50 second time period. If not, the microprocessor proceeds back through step 179 to step 111, in the process clearing all inputted keyboard information and the display.

Assuming a keyboard entry was detected in step 199, the microprocessor determines in step 203 whether the CLR key was pressed. Again, if it was, the program branches back through step 179 where all entries and displays are cleared to step 11 where a new copy selection input is awaited. If the CLR key was not pressed, the microprocessor proceeds to steps 205, 207 and 209 where it sequentially determines whether one of the keys "1," "2" or "3" was pressed. If none of these keys was pressed, the microprocessor proceeds to the "try again routine" in step 211 and then back to step 199. The "try again" routine of step 211 is identical to that of step 185.

Assuming one of the keys "1," "2" or "3" was pressed, the microprocessor then proceeds to respective steps 213, 215 or 217. In step 217 the microprocessor, having determined a "1" was pressed, extinguishes the message lights ALTERNATE PAPER TRAY 2 and NO (area 51) leaving the ALTERNATE PAPER TRAY 1 message corresponding to the selected feature lit. In step 215 the microprocessor, having determined that a "2" was pressed, extinguishes the message lights ALTERNATE PAPER TRAY 1 and NO (area 51)

leaving the message ALTERNATE PAPER TRAY 2 lit. In step 217 the microprocessor, having determined a "3" was pressed, extinguishes all message lights, i.e., ALTERNATE PAPER TRAY 1, ALTERNATE PAPER TRAY 2, and NO (area 51).

If a "1" was pressed by an operator, the program proceeds from step 213 to step 219 where an instruction is sent to the copying machine to select the first alternate paper tray. If a "2" was pressed, the microprocessor processor proceeds to step 221 through step 215 where it sets the copying machine to the second alternate paper tray configuration. If a "3" was pressed, nothing is done and the copying machine remains set to use the usual paper tray. The microprocessor next advances to step 223 following steps 217, 219 or 221.

In step 223 the microprocessor extinguishes the message lights of the first row of display group 15: that is, ENTER, "1," OR (area 37), "2," OR (area 41), and "3." Thereafter, in step 225, the microprocessor also extinguishes cursor light 71 and lights cursor light 73. The microprocessor next proceeds to step 227 which begins a routine for selecting the function of stacked or stapled copies, or neither. In step 227, the microprocessor lights the message lights STAPLED COPIES, STACKED COPIES, NO (area 49), in row 3 of display group 15 and ENTER, "1," OR (area 37), "2," OR (area 41), and "3" in row 1 of display group 15. At this stage, the operator is instructed to press one of the keys "1," "2" or "3" depending on whether one of the machine functions of stapled copies, stacked copies, or neither is desired.

Following step 227, the microprocessor proceeds to step 229 where it checks to see if a keyboard entry occurs within a 50 second period. If not, the microprocessor branches back to step 179 as described above. If a keyboard entry was received within the 50 second interval, the microprocessor proceeds to step 233 where it determines if the CLR key was pressed. If it was, the microprocessor again branches back to step 179. If the CLR key was not pressed, the microprocessor then proceeds to step 235 where it checks to see if a "1" was pressed. If a "1" was not pressed the microprocessor then proceeds to step 237 where it checks to see of a "2" was pressed. If a "2" was not pressed, the microprocessor proceeds to step 239 to check whether a "3" was pressed. If a digit other than "1," "2," or "3" was pressed, the microprocessor exits from step 239 to step 241 where it executes the "try-again routine" described above, exiting from there back to step 229 awaiting the next keyboard entry.

Assuming a "1," "2" or "3" was pressed by an operator, the microprocessor will branch out of one of the steps 235, 237 and 239 down to respective steps 243, 245 or 247. In step 243, the microprocessor, having determined a "1" was pressed in step 235, extinguishes the lights for STACKED COPIES and NO (area 57) and then sets a stapled copy mode in the copying machine in step 244. If the microprocessor branches from step 237 to step 245, upon recognizing a "2" was pressed, it extinguishes the message lights STAPLED COPIES and NO (area 57) and proceeds to set the copying machine to a stacked copy mode in step 246. Finally, if the microprocessor branches to step 247 via step 239, upon recognizing a "3" was pressed, it extinguishes the message lights STACKED COPIES, STAPLED COPIES, and NO (area 57). As a result, as the microprocessor begins to execute step 249, one of the two message lights STAPLED COPIES or STACKED COPIES will remain lit and the copying machine set accordingly if one of these functions was selected by an operator pressing a "1" or "2" key.

In step 249 the microprocessor resets the display group 15 for selection of the next function by extinguishing all message lights in the top row; that is ENTER, "1," OR (area 37), "2," OR (area 41), and "3." Proceeding to step 251, the microprocessor also extinguishes cursor light 73 and lights cursor light 75. In addition, in step 253 the microprocessor also lights the remaining message lights of row 5 of display group 15 including ONE SIDED ORIGINAL ▷ TWO SIDED COPY, TWO SIDED ORIGINAL ▷ TWO SIDED COPY, and NO (area 61). The appropriate message lights in row 1 are also lit which include the message lights, ENTER, "1," OR (area 37), "2," OR (area 41), and "3."

At this point the microprocessor has configured display group 15 to instruct an operator to enter a "1," or "2," or "3" depending on whether the operator desires a one sided original to two sided copy function, a two sided original to two sided copy function, or neither of these.

In step 255 the microprocessor again looks for a keyboard entry within 50 seconds and, if none is received, it exits back to step 179. Assuming the microprocessor detects a keyboard entry within the prescribed time, it then checks to see whether the CLR key was pressed and if so, again branches back to step 179. If the CLR key was not pressed as determined in step 259, the microprocessor proceeds to step 261 where it determines whether the "1" key was pressed. If not it determines in step 263 whether the "2" key was pressed, and if not it then proceeds to step 265 where it determines if the "3" key was pressed. If a digit other than "1," "2," or "3" was pressed, the microprocessor proceeds to step 267 where it executes the "try again routine" discussed above branching from there back to step 255 where it awaits a proper keyboard entry.

If an operator pressed the "1" key as detected in step 261, the microprocessor proceeds to step 269 where it extinguishes the message lights TWO SIDED ORIGINAL ▷ TWO SIDED COPY and NO (area 61). If the microprocessor detects in step 263 that the "2" key was pressed, it proceeds to step 271 where it extinguishes the light ONE SIDED ORIGINAL TWO SIDED COPY and NO (area 61). Finally, if the microprocessor detects in step 265 that the key "3" was pressed, it proceeds to step 273 where it extinguishes all lights in row 5 of display group 15; that is ONE SIDED ORIGINAL TWO SIDED COPY, TWO SIDED ORIGINAL TWO SIDED COPY, and NO (area 61).

If the operator did pressed the "1" key, the microprocessor proceeds from step 269 to step 275 where it sets the machine to reproduce a two sided copy from a one sided original. If the microprocessor detects that the "2" key was pressed it exits from step 271 to step 277 where it sets the machine to reproduce a two sided copy from a two sided original. Of course, if the microprocessor detects that the key "3" was pressed no machine change is effected and the usual one sided copy from one sided original copy mode is used by the copying machine.

Upon exiting respective steps 275, 277 or 273 the microprocessor proceeds to step 279 where it again extinguishes all message lights in the first row of display group 15 in preparation for the next operator prompting message. In step 281 the microprocessor extinguishes cursor 75 and lights cursor 77, while in step 283 the microprocessor causes display group 15 to display the next operator prompting message. In step 283 the microprocessor lights the ENTER, "1," OR (area 35) and "3" lights of the first message light row of display group 15. It also lights in row 6 of display group 15 the lights REDUCTION and NO (area 67). As a result, the operator is instructed to press a "1" and a "3" depending on whether copy reduction is desired, or not.

Proceeding to step 285 the microprocessor determines whether a keyboard entry is received within a 50 second period and, if not, jumps back to step 179 as described above. If a keyboard entry is received, the microprocessor then branches to step 289 where it determines whether the CLR key was pressed. If the CLR key was pressed, the microprocessor branches back to step 179. If the CLR key entry was not pressed, the microprocessor proceeds from step 289 to step 291 where it determines whether the "1" key was pressed. If it was not, the microprocessor proceeds to step 293 where it determines whether the "3" key was pressed. If neither of these entries are detected, the microprocessor branches to step 295 where it executes the "try again routine" discussed above and returns to step 285 awaiting a proper keyboard entry.

If a "1" entry is detected in step 291 the microprocessor proceeds to step 297 where it extinguishes the NO (area 67) light allowing the REDUCTION message light to remain lit. Thereafter, the microprocessor proceeds to step 301 where it lights the message SEE PLATEN GLASS (area 65) in display group 15 which instructs an operator to observe the platen glass for further instructions for introducing reduction information via the keys 79 of keyboard 17. At the platen glass, an operator can view instructions which may, for example, instruct that a "1" be pressed for a 98% reduction, a "3" be pressed for a 74% reduction, etc. For the purposes of further description, it will be assumed that there are two possible reduction states, 98% and 74% respectively corresponding to a keyboard entry of a "1" and "3."

After instructing an operator to see the platen glass in step 301, the microprocessor then proceeds to step 303 where it awaits a keyboard entry for a reduction amount determining whether such entry is received within a 50 second duration. If not, then the microprocessor returns to step 179 as described above. Assuming a keyboard entry is received within the 50 second interval, the microprocessor proceeds to step 307 where it determines whether the CLR key was pressed or not. If the CLR key was pressed, the microprocessor returns to step 179 and, if not, it proceeds to step 309 where it determines whether the "1" key was pressed. If the "1" was not pressed then the microprocessor proceeds to step 311 where it determines whether the "3" key was pressed. If neither the "1" nor "3" key was pressed, the microprocessor advances to step 313 where it executes the "try again routine" described above proceeding from there to step 303 to await a proper keyboard entry.

Assuming a "1" was pressed by an operator indicating a 98% reduction selection, the microprocessor proceeds from step 309 to step 315 where it sets the copying machine to a 98% reduction mode. If 74% reduction were selected by an operator pressing the "3" key, the microprocessor proceeds from step 311 where it detects that a "3" was pressed to step 317 where it sets the copying machine to a 74% reduction mode. For either step 315 or 317 the microprocessor then advances to step 319 where a delay period is established to allow the copying machine to assume its proper reducing mode. From step 319 the microprocessor proceeds to step 323 where it lights the READY message light in display group 13 and extinguishes cursor light 77. From step 323 the microprocessor then proceeds to step 131 of the print routine to begin a copying operation. In lieu of branching to step 131 which requires a manual entry by the operator of the START PRINT key to start the printing process, the microprocessor can instead jump from step 323 directly to step 139 to automatically initiate a copying operation.

As evident from the above, the present invention provides a progressive message display operator console which sequentially guides an operator through the maze of copy select and function select keyboard inputs required to properly set a copying machine to perform a desired copying operation. A single keyboard is utilized for both selecting the number of copies and the desired copying machine functions in conjunction with a progressive message display to reduce the possibility of operator entry errors and the number of keys and associated components normally required in a copying machine console.

Although the invention was described with references to several specific conventional copying machine functions, other functions may also be added or subtracted as desired. One function which might be added would be a sorting function utilized in lieu of the stapled or stacked copies function. For any such added function, the sequence of steps executed by the microprocessor will basically be the same, the microprocessor prompting an operator by a display message in row 1 of display group 15 and additional message light in a subsequent row of display group 15 to make an appropriate keyboard entry corresponding to a selected function. Once the selection is made, the microprocessor then examines the keyboard input and acts accordingly to extinguish the lights corresponding to the nonselected function (or all lights if a NO selection is made) and thereafter appropriately sets the mechanical aspects of the machine via interface 90 to perform this function, following which the microprocessor repeats this operation for the next selectable function until keyboard entries for all functions are complete.

Although the flow chart program disclosed in FIG. 3 is illustrated as an independent program, this program can form part of a larger overall microprocessor operating program for a copying machine. For example, U.S. Pat. No. 4,035,072 discussed above, discloses a microprocessor executing an overall operating program for a sophisticated copying machine which includes an input subroutine for sensing operator keyboard entries for various desired features, operations, and number of copies as well as a printing subroutine. The program illustrated in FIG. 3 could be used as the input keyboard subroutine in such a system in which case the basic print routine illustrated in steps 131 through 155 of FIG. 3 can be eliminated.

As also evident from the above, the feature selection display message routine is only entered after an operator is afforded a delay period during which the OK key must be pressed. If the OK key is not pressed during this time delay, the function selection routines are aborted and the microprocessor advances directly to a printing subroutine.

Using the progressive prompting operator console as described above insures that an operator will guided step-by-step through the copy select and function selection operations thus ensuring that all desired functions will be selected and minimizing the possibility of function selection errors. Moreover, the progressive display console of the invention is relatively simple in construction and can be readily configured to meet differing requirements both in display and in available features.

While a preferred embodiment of the invention has been described above in connection with the accompanying drawings, it is to be understood that this embodiment is only exemplary of the invention and that various modifications can be made without departing from the spirit and scope of the invention. For example, the progressive disclosure console could also be used on machines other than copying machines, wherever a series of function selections is required. Accordingly, the invention is not limited by the foregoing description, but is only limited by the appended claims.

We claim:

1. A progressive display operator console for a copying machine comprising:

a keyboard having predetermined keys for selecting a number of copies to be reproduced by said machine;

a copy number display for displaying a selected number of copies;

a message display comprising a plurality of individual operator prompting messages selectively displayed to an operator to instruct an operator in the selection of available copying machine functions; and, control means coupled to said keyboard, said copy number display, and said message display for operating said message display to display a message prompting an operator to enter a number of desired copies with said predetermined keys of said keyboard and for sequentially displaying selected messges instructing an operator to enter, with said predetermined keys, machine function selection information, said control means being responsive to the number of desired copies and function selection information entered by an operator with said keys to cause said copy number display to display the desired number of copies and for conditioning said copying machine to operate according to said function selection information, said message display providing a function selection message instructing the operator to actuate predetermined ones of said predetermined keys to select a desired copying machine function, said control means being responsive to subsequent actuation of said predetermined ones of said predetermined keys to condition said copying machine to operate according to an operator selected function and to display another function selection message.

2. A progressive display operator console as in claim 1 wherein said control means operates said message display to display a message instructing an operator to enter a desired number of copies by said predetermined keys and thereafter, in response to an operator copy number entry, causes said copy number display to display the number of copies entered, said control means operating said message display to sequentially display predetermined function selection messages, each function selection message instructing an operator to enter machine function information by predetermined ones of said predetermined keys.

3. A progressive display operator console as in claim 2 wherein as said control means sequentially operates said message display to display said function selection messages said control means causes said message display to display messages indicating operator selected functions.

4. A progressive display operator console as in claim 1, 2, or 3 wherein said control means clears said copy number display and said message display and reverts to a predetermined starting state if no keyboard entry is received within a predetermined period of time following the display of a message prompting an operator input at said keyboard.

5. A progressive display operator console as in claim 2 wherein said control means causes said message display to display a message instructing an operator to enter a predetermined keyboard pattern to initiate a function selection operating mode of said control means, and said control means responds to the lack of said predetermined keyboard pattern being entered during a predetermined period of time to cause said message display to display a message instructing an operator to commence a copying operation of said copying machine, said control means being responsive to entry of said predetermined keyboard pattern during said predetermined period of time to enter said function selection operating mode.

6. A progressive display operator console as in claim 1 wherein said message display includes a display group comprising rows and columns of message areas, the message areas in one row of said display group instructing an operator to actuate one of said predetermined keys to select a desired function, the message areas in each of the other rows of said display group instructing an operator which functions are available for selection, predetermined ones of the message areas in said one row of said display group corresponding to preselected keys of said predetermined keys aligning in columns with function selection message areas in said display group formed by said other rows such that display of selected message areas in said one row together with display of selected message areas in one of said other rows instructs an operator to actuate a key which has its associated message area aligned in the column of the message area of the desired function.

7. A progressive display operator console as in claim 6 wherein each of said other rows of said display group includes a cursor message area which directs operator attention to the function selection message areas in the row associated therewith.

8. A progressive display operator console as in claim 6 wherein said one row is the first row of said display group.

* * * * *